US006779597B2

(12) United States Patent
DeMarche et al.

(10) Patent No.: US 6,779,597 B2
(45) Date of Patent: Aug. 24, 2004

(54) MULTIPLE IMPINGEMENT COOLED STRUCTURE

(75) Inventors: Thomas Edward DeMarche, Boxford, MA (US); Robert Francis Manning, Newburyport, MA (US)

(73) Assignee: General Electric Company, Schenectady, NY (US)

( * ) Notice: Subject to any disclaimer, the term of this patent is extended or adjusted under 35 U.S.C. 154(b) by 201 days.

(21) Appl. No.: 10/053,534

(22) Filed: Jan. 16, 2002

(65) Prior Publication Data

US 2003/0131980 A1 Jul. 17, 2003

(51) Int. Cl.[7] ..... F28F 3/12; F04D 29/38

(52) U.S. Cl. ..... 165/169; 165/908; 415/115

(58) Field of Search ..... 165/109.1, 133, 165/908, 169; 415/115, 116, 173.1, 176, 178, 189

(56) References Cited

U.S. PATENT DOCUMENTS 4,497,610 A * 2/1985 Richardson et al. ..... 415/116
4,526,226 A 7/1985 Hsia et al. ..... 165/109 R
4,573,865 A 3/1986 Hsia et al. ..... 415/115
4,690,210 A * 9/1987 Niggemann et al. ..... 165/159
4,694,894 A * 9/1987 Kito et al. ..... 165/135
5,016,707 A * 5/1991 Nguyen ..... 165/167
5,157,935 A * 10/1992 Gregory ..... 165/908
5,353,865 A * 10/1994 Adiutori et al. ..... 165/133
5,584,651 A * 12/1996 Pietraszkiewicz et al. .. 415/115
5,623,827 A 4/1997 Monty ..... 60/748
6,036,441 A 3/2000 Manning et al. ..... 416/97 R
6,122,917 A 9/2000 Senior ..... 60/752
6,174,134 B1 1/2001 Lee et al. ..... 416/97 R
6,179,557 B1 * 1/2001 Dodd et al. ..... 415/115

OTHER PUBLICATIONS

Serial No.: 09/867,294, Entitled "Integral Nozzle and Shroud" filed May 29, 2001.

* cited by examiner

*Primary Examiner*—Henry Bennett
*Assistant Examiner*—Tho V Duong
(74) *Attorney, Agent, or Firm*—Adams Evans P.A.; David L. Narciso

(57) ABSTRACT

A multiple impingement cooled structure is provided having two or more stages of impingement cooling wherein the stages are arranged so as to have substantially constant cooling effectiveness.

12 Claims, 3 Drawing Sheets

MULTIPLE IMPINGEMENT COOLED STRUCTURE

STATEMENT REGARDING FEDERALLY SPONSORED RESEARCH & DEVELOPMENT

The U.S. Government may have certain rights in this invention pursuant to contract number DAAH10-98-C-0023 awarded by the Department of the Army.

BACKGROUND OF THE INVENTION

This invention relates generally to a multiple impingement cooled component and more particularly to a multiple impingement cooled component having improved consistency in its cooling effectiveness.

Structures, such as turbine shrouds and nozzle bands, which are subjected to high temperatures must be cooled in order to reduce possible damage caused by undesirable thermal distress and to maintain satisfactory sealing characteristics. Several methods of cooling such structures are currently being successfully employed.

One method of cooling structures is impingement cooling. In impingement cooling, air is directed to impinge substantially perpendicularly upon the surface of a structure to be cooled. When used on a turbine shroud, for example, cooling air is directed to impinge upon the back or outer surface of the shroud, that is, the surface not facing the gas flowpath. The source of the cooling air for both impingement and film cooling air in most gas turbine engines is high pressure air from the compressor. For effective impingement cooling of the entire turbine shroud in current impingement cooling arrangements, a relatively large amount of cooling air must be employed and thus the compressor must work harder to supply the cooling air. Thus, when a large amount of cooling air is required for impingement cooling, engine efficiency is reduced.

Furthermore, It is also known to incorporate multiple stages of impingement, in which cooling air is impinged through a first baffle, then accumulated and used to impinge through a second baffle, which in effect reuses the cooling air flow, lowering the overall cooling air flow requirement. However, in prior art multiple impingement designs the cooling effectiveness degrades as the cooling air flows downstream, both because of losses inherent to flow through a closed structure and because the prior art designs are not arranged so as to provide consistent impingement conditions from one stage to the next. This can lead to undesirable thermal gradients and shortened component life. Furthermore, inconsistency in cooling from one portion of a component to another can create complications when attempting to reduce cooling air flows supplied to a component to the minimum possible, because the portions of the component having the highest temperatures drive the cooling flow requirements.

Accordingly, there is a need for a multiple impingement cooled structure having improved consistency in its cooling effectiveness.

BRIEF SUMMARY OF THE INVENTION

The above-mentioned need is met by the present invention, which provides a multiple impingement cooled structure having two or more stages of impingement cooling wherein the stages are arranged so as to have substantially constant cooling effectiveness.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
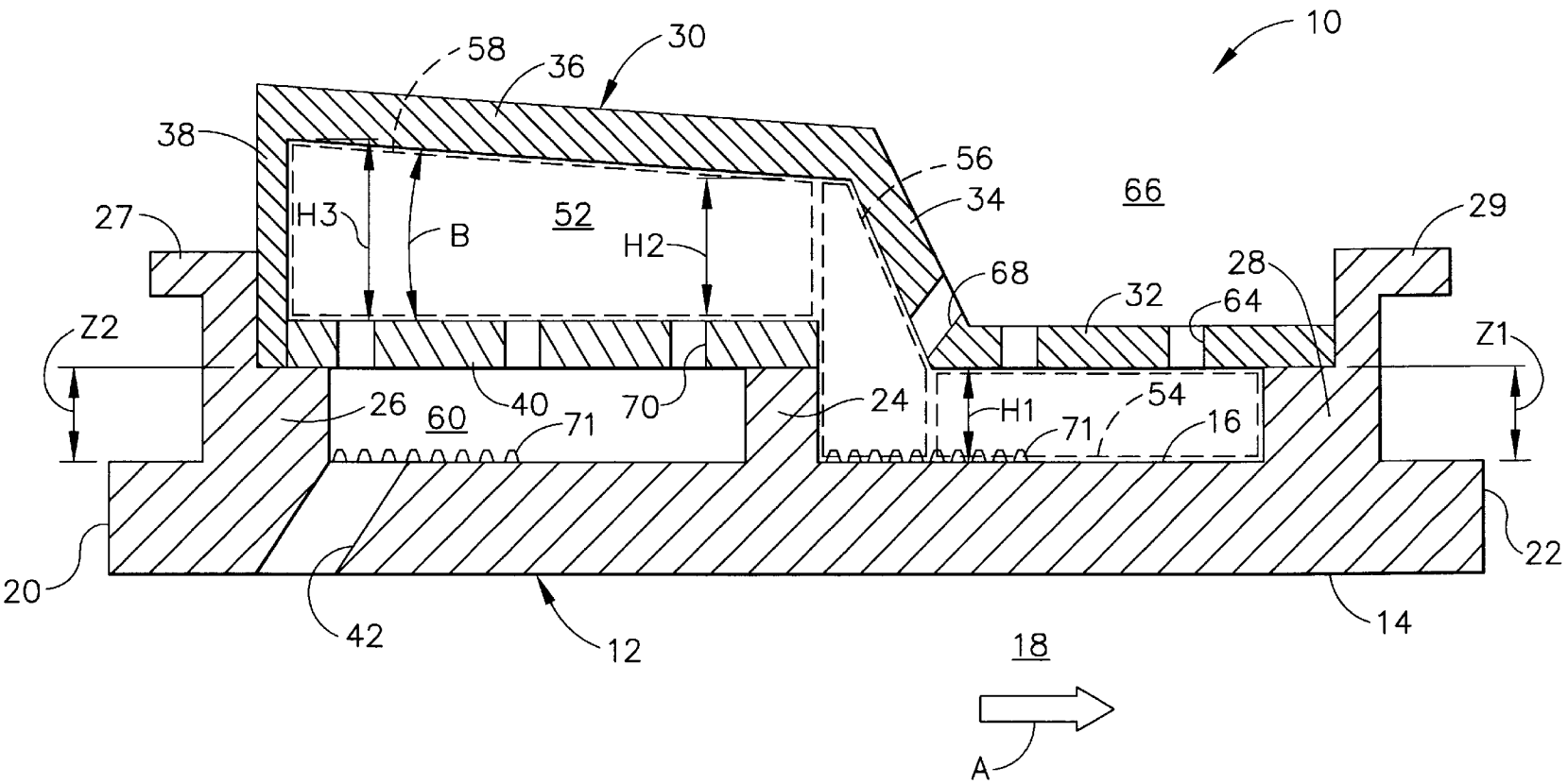
FIG. 1 is a schematic cross-sectional view of an exemplary turbine shroud embodying the impingement-cooled structure of the present invention.

Referring to the drawings wherein identical reference numerals denote the same elements throughout the various views, FIG. 1 shows the structure of the present invention in the exemplary embodiment of a turbine shroud 10. It is to be understood, however, that the present invention can be also be successfully employed in a turbine nozzle band assembly or in any other appropriate manner where is desired to cool an element exposed to high temperature.

A turbine shroud 10 typically surrounds a row of rotating turbine blades (not shown). The shroud 10 is shaped so as to properly define a boundary of the gas flowpath 18. In the case of a gas turbine engine, the shroud 10 is generally annular, more particularly being generally cylindrically shaped, because the gas flowpath 18 has a generally annular shape. The shroud 10 can be circumferentially continuous or it can comprise a plurality of circumferentially adjacent segments, in the latter case the individual segments of the shroud 10 being arcuate. A single segment is illustrated as an example herein.

As can be seen in FIG. 1, the structure, or shroud 10, comprises a base 12, including an inner surface 14 facing toward the gas flowpath 18 and an outer surface 16 facing away from the gas flowpath 18. The base 12 also includes upstream and downstream edges 20 and 22, respectively. By "downstream" is meant the direction the gases flow past shroud 10 as shown by arrow A, and by "upstream" is meant in the opposite direction. Again referring to FIG. 1, the shroud 10 includes at least one rib 24 extending from the outer surface 16 in a generally radially outward direction. The rib 24 may be disposed on the base 12 approximately near the center of the shroud and may be integrally formed with the base 12 or may be formed separately and attached to the base 12. The function of the rib 24 will be explained hereinafter.

The shroud 10 further comprises an upstream flange 26 and a downstream flange 28 disposed on opposite sides of the rib 24 and extending radially outwardly from the outer surface 16 of the base 12. The upstream and downstream flanges 26 and 28 may extend from the shroud 12 at or near the upstream and downstream edges 20 and 22, respectively, thereof. When the shroud 10 is generally annular, the upstream and downstream flanges extend in a generally radial direction. If necessary for enabling attachment of the shroud 10 to another member, the upstream and downstream flanges 26 and 28 can include any known type of attachment structure, for example lips 27 and 29, respectively.

A first baffle 30 extends between the upstream and downstream flanges 26 and 28 and is spaced from the base 12, and from the rib 24. The first baffle 30 has first, second, third, and fourth sections, denoted 32, 34, 36, and 38 respectively. The first section 32 is flat and generally parallel to the outer wall 16 of the base 12. The second section 34 extends away from the first section at an oblique angle. The third section extends towards the upstream end 20. The fourth section 38 extends parallel to upstream flange 26. The fourth section 38 may be a portion of the baffle 30 or may be formed as part of the upstream flange 26. A second baffle 40 extends between the upstream flange 26 and the rib 24 and is spaced between the first baffle 30 and the base 12. The first baffle 30 and the second baffle 40 may be separate pieces that are attached to the base 12, for example by mechanical fasteners or brazing, or the baffles may be integrally formed with the base 12.

A first cavity 52 is defined within the shroud 10 by the first baffle 30, the upstream and downstream flanges 26 and 28, a downstream portion of the base 12, the rib 24 and the second baffle 40. The first cavity may be divided into first, second, and third portions labeled 54, 56, and 58 respectively, shown by dashed lines in FIG. 1. A second cavity 60 is defined within the shroud 10 by the second baffle 40, the rib 24, the upstream flange 26, and an upstream portion of the base 12. Although the invention has been described in terms of "upstream" and "downstream" directions, it should be noted that the arrangement of flow between the first cavity 52 and the second cavity 60 is not related to the overall direction of flow past the shroud 10, and that the invention would work equally well if the positions of cavities 52 and 60 were reversed, i.e. if the first cavity 52 were upstream of the second cavity 60.

The first baffle 30 includes a plurality of impingement holes 64 extending through the first section 32 thereof for directing impingement cooling air from a source, such as the plenum 66 which is exterior to the shroud 10, against the portion of the base 12 that is within the first cavity 52. In the configuration shown in FIG. 1, the impingement cooling air flowing through the impingement holes 64 would be directed only against the downstream portion of the base 12. The first baffle 30 also includes a plurality of angled impingement cooling holes 68 located in the second section 34 thereof which direct flow towards rib 24. The second baffle 40 also includes a plurality of impingement holes 70 therethrough for directing impingement cooling air from the first cavity 52 against the portion of the base 12, within the second cavity 60. In the configuration shown in FIG. 1, the impingement cooling air flowing through the impingement holes 70 would be directed against only the upstream portion of the base 12.

Figure 2:
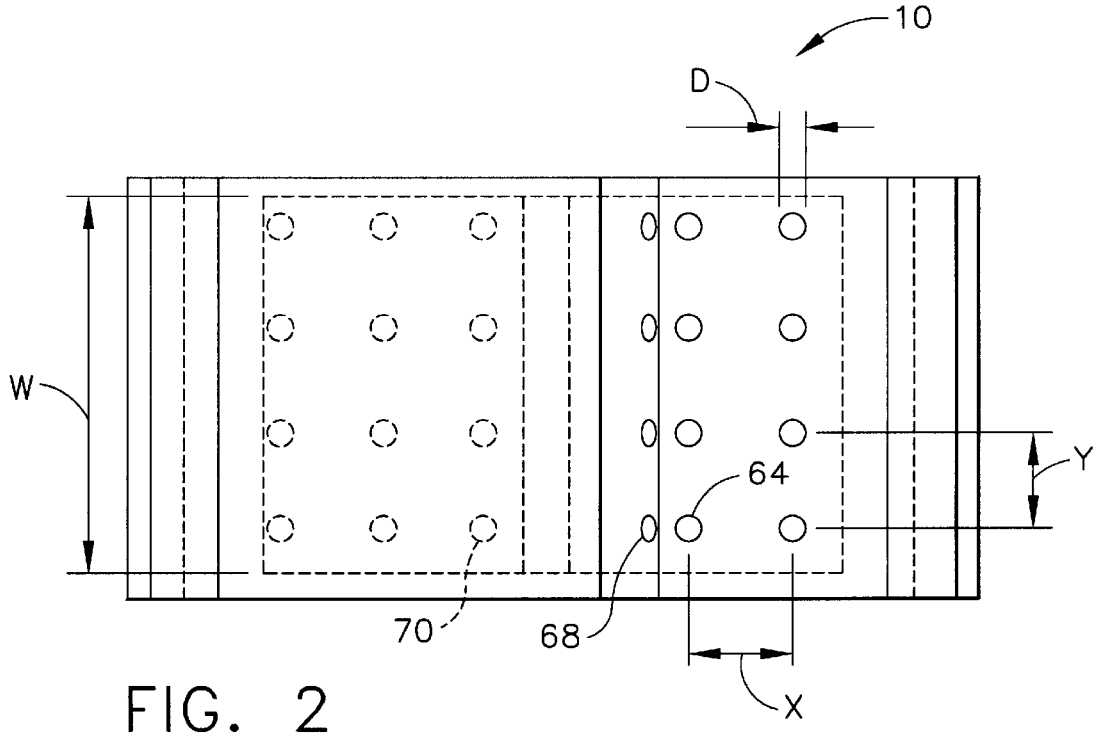
FIG. 2 is a top view of the turbine shroud of FIG. 1.

Referring to FIG. 2, The first and second impingement holes have a diameter D. The diameter of the impingement cooling holes 64, 68, and 70 are typically equal and may be about 0.51 mm (0.02 in.) in an exemplary embodiment. The holes have a spacing of X, typically about 2.1 mm (0.080 in.) in a first direction and a spacing of Y, typically about 2.1 mm (0.08 in.) in a second direction from each other. The first and second cavities may have a common width W. The exits of the impingement cooing holes 64 in the first baffle 30 are a distance Z1 from the outer surface 16 of the base 12 and the exits of the impingement cooling holes in the second baffle 40 are a distance Z2 from the outer surface 16 of the base 12.

Figure 3:
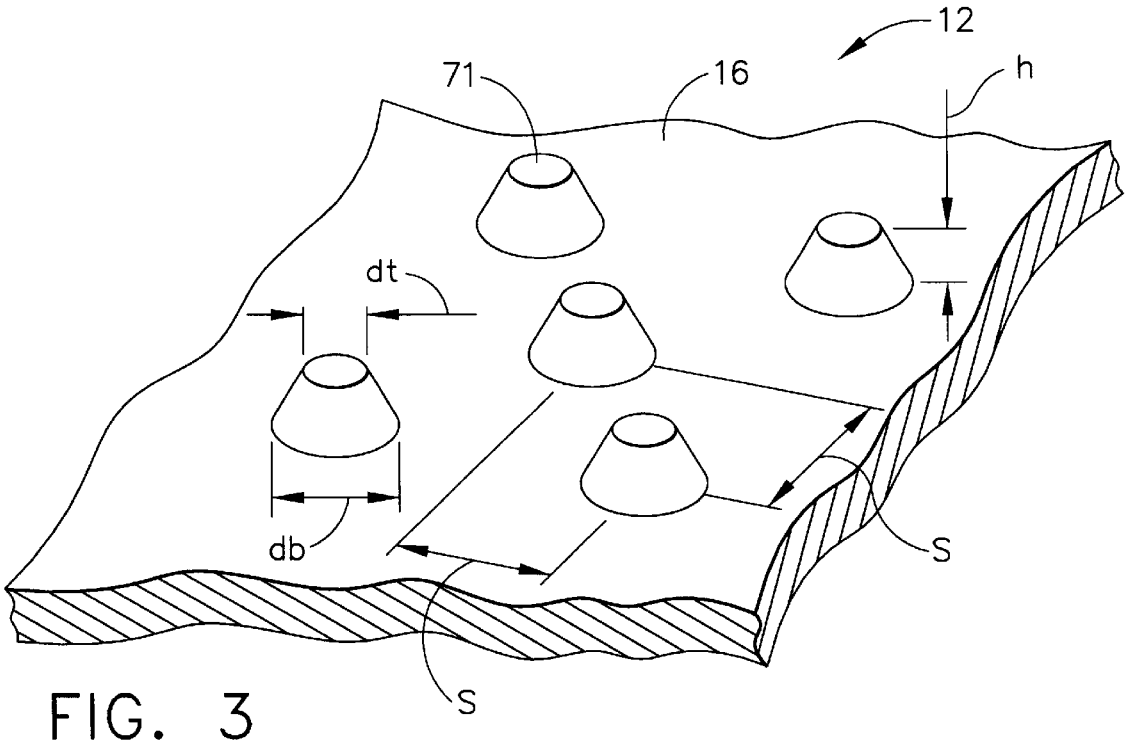
FIG. 3 is a perspective view of a portion of the shroud of FIG. 1.

The outer surface 16 of the base 12 may have a surface that is selectively roughened through the incorporation of one or more pluralities of projecting members 71. Typical projecting members 71 may be formed as part of the base casting, or may be formed by machining, or by other methods such as braze or weld build-up. The projecting members 71 extend into the internal passage of the base 12 through which the cooling air is channeled. The projecting members 71 enhance the convective heat transfer coefficient along the outer surface 16 of the base 12 by increasing the convective surface area and by enhancing the impingment turbulence. In an exemplary embodiment, illustrated in FIG. 3, the projecting members 71 may take the form of small truncated cones which are incorporated into the casting of the base 12. These truncated cones are disposed in the downstream portions of the first 52 and second 60 cavities in the shroud 10. Exemplary truncated cones would have a base diameter db of about 0.51 mm (0.02 in.), a tip diameter dt of about 0.25 mm (0.01 in.), and a height h of about 0.38 mm (0.015 in.). The truncated cones have a spacing S of approximately 1.27 mm (0.05 in.) apart. The dimensions and spacings may be varied to suit a particular application. For example, larger cones and/or denser spacing of the cones would further increase the local heat transfer coefficient at the expense of creating increased pressure losses.

In operation, cooling air from the plenum 66 enters impingement cooling holes 64 and 68 in the first baffle 30. This cooling air impinges upon the portion of the outer surface 16 of the base 12 that is within the first cavity 52 and upon the rib 24. The holes 68 are angled so as to particularly direct cooling flow towards the rib 24. The cooling air then flows over the rib 24 through the second portion 56 of the first cavity 52, and is then accumulated in the third portion 58 of the first cavity 52. Subsequently the cooling air flows through impingement cooling holes 70 to impinge upon the portion of the outer surface 16 that is within the second cavity 60. The spent impingement air is then exhausted through one or more exit passages 42 after which it can be used for other purposes, for example to provide film cooling of the inner surface 14 of the base 12, or to supply yet another stage of impingement cooling, or to supply cooling air to any nearby structures, for example a turbine nozzle, as described in more detail below.

The factors affecting the impingement cooling effectiveness in the first and second cavities 52 and 60 include the rate of flow of cooling air, the pressure ratio of the cooling air across the impingement baffle, the impingement cooling hole diameter, the distance between the exit of the impingement cooling hole and the cooled surface (referred to as the impingement distance), the lateral spacing of the impingement cooling holes in the impingement baffle, the amount of cross-flow degradation resulting from adjacent impingement cooling holes, and the surface roughness of the cooled surface. In the present invention, modifications have been made affecting one or more of these factors in order to compensate for the degradation in cooling flow experienced in prior art designs. These modifications are described in more detail below.

The present invention has the advantage of being a multiple impingement design, that is, the cooling air which is supplied from plenum 66 is used in more than one stage of impingement in the cooling of the shroud 10. This allows the cooling air flow to be in effect re-used. For example, in the shroud 10 illustrated in FIG. 1, the cooling air flows through three rows of impingement cooling holes 64, 68, followed by three additional rows of impingement cooling holes 70. This requires only about half of the cooling air flow required if the cooling air were directed through all six rows of impingement cooling holes simultaneously, as is common in impingement cooled structures. This re-use of the cooling air is possible because in a single-stage impingement structure, the cooling air typically has adequate pressure and temperature margins to provide additional cooling even after it has exited the impingement cooled component. The cooling air may be reused in this manner, i.e. accumulated and redirected through additional sets of impingement cooling holes, for so long as the temperature of the air is not too high and the pressure is not too low. The multiple impingement arrangement also has a benefit in that it reduces the number of adjacent rows of impingement cooling holes. This reduces the effect of cross-flow degradation, which is an effect wherein an impingement jet must turn and flow down a channel after impinging upon a surface, in the process deflecting the subsequent jet and degrading its heat transfer coefficient. The greater the number of rows, the greater this cross-flow degradation. In the illustrated example, the number of adjacent rows is reduced from six to three. Of course, as the air flows through the multiple impingement arrangement, the temperature of the cooling air increases as it picks up heat from the surrounding structure. Since this reduces the temperature difference between the cooling air and the structure being cooled, the rate of cooling tends to decrease as the air flows through subsequent portions of the cooled structure. The present invention provides several features useful for mitigating this reduction in cooling effectiveness by increasing the local heat transfer coefficient in selected areas of the cooled structure, thus making the effectiveness more consistent.

One distinct advantage of the present invention over the prior art is the equalization of impingement distances in the first 52 and second 60 cavities, respectively. As can be seen in FIG. 1, the first baffle 30 has first, second, and third sections, labeled 32, 34, and 36 respectively. The first section 32 is spaced away from the outer surface 16 of the base 12 by a distance Z1. The second section 34 is disposed at an angle to the first section 32 and extends away from the base 12, and the third section 36 is disposed at an angle to the second section 34 and extends towards the upstream flange 26 to enclose the third section 58 of the first cavity 52, creating a plenum area for the spent cooling air from the first portion 54 of the first cavity 52 to be accumulated. The second baffle 40 is spaced away from the outer surface 16 of the base 12 a distance Z2 that is substantially equal to the distance Z1. Since Z1 and Z2 are equal, or nearly so, this will tend to make the impingement cooling effectiveness more consistent from the first cavity 52 to the second cavity 60. In an exemplary embodiment, impingement distances Z1 and Z2 would be equal to about 1.14 mm (0.045 in.). Alternatively, the impingement distances Z1 and Z2 could be slightly varied from each other, for example distance Z2 could be slightly decreased in order to make the impingement cooling effectiveness in the second cavity 52 more nearly equal to that in the first cavity 30. Preferably, if the impingement distances Z1 and Z2 are not equal to each other they are within about 25% of each other.

The cooling air experiences a drop in static pressure from the flow losses in transiting the interior spaces of shroud 10. This pressure drop has the effect of reducing the impingement pressure ratio of the impingement holes that are downstream with respect to the cooling air flow sets compared to the initial holes. In order to partially mitigate the effect of that pressure drop, the height H1 at the junction of the second portion 56 of the first cavity 52 and the first portion 54 of the first cavity 52 is less than the height H2 at the junction of the third portion 58 of the first cavity 52 and the second portion 56 of the first cavity 52. In other words, the area of the second portion 56 increases in the downstream direction relative to the flow of the cooling air. This has the effect of flow through a diffuser, which increases the static pressure of the flow at the expense of flow velocity. In an exemplary embodiment, the ratio of heights H2 to H1 (and thus the areas at those locations for a constant width W) is about 1.5. This ratio may be varied to suit a particular application.

The cooling air also experiences a drop in static pressure from the flow losses in transiting the interior spaces of shroud 10 in the third portion 58 of the first cavity 52. In order to counteract this pressure drop, the third section 36 of the first baffle 30 may be disposed at an angle B relative to the second baffle 40 as depicted in FIG. 1. This has the effect of increasing the area of the third portion 58 of the first cavity 52 near the fourth section 38 of the first baffle 30 relative to the area of the third portion 58 of the first cavity 52 near the intersection of the second portion 56 and the third portion 58, i.e. height H3 is greater than height H2, with width W being constant. This has the effect of flow through a diffuser, which increases the static pressure of the flow at the expense of flow velocity. The net result is that the impingement pressure ratio (i.e. the ratio of the pressure on the supply side of the baffle 40 to the exit side of the baffle 40) at the end of the third portion 58 is greater than at the beginning of the third portion 58 with respect to the direction of cooling flow, offsetting the loss of cooling efficiency caused by increasing cross-flow degradation as the spent flow progresses down the cavity. The angle B and the overall height of the third section 36 of the baffle 30 may be modified to suit a particular application. An exemplary ratio of H3 to H2 is about 1.3.

Although an exemplary embodiment of the present invention has been described in the context of a turbine shroud 10 having two sequential sets of impingement cooling holes, it is noted that the invention may also incorporate three or more sets of impingement cooling holes arranged so that the cooling air expended from one set of holes is accumulated and then used to supply another set of impingement cooling holes. The additional benefit of Each additional stage of multiple impingement is roughly proportional to the total number of stages. For example, a 3-stage arrangement would consume approximately ⅓ the of cooling air flow of a single stage impingement. The addition of further impingement stages (and thus the re-use of the cooling air flow) is limited only by the point at which the temperature rise and pressure drop of the cooling air flow exceed allowable limits.

Figure 4:
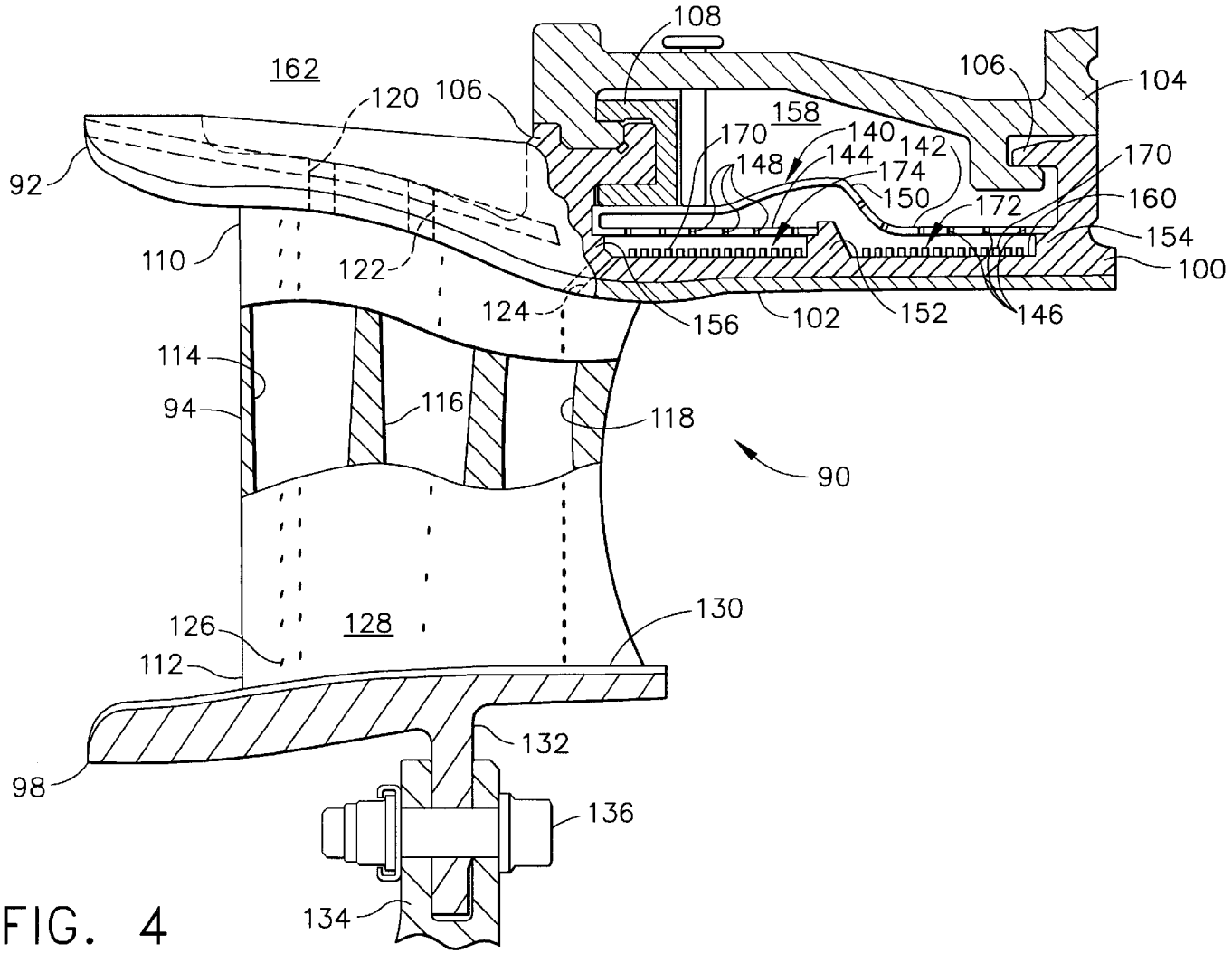
FIG. 4 is a cross-sectional view of the present invention embodied in an integral nozzle-shroud structure.

Another embodiment of the present invention is illustrated in FIG. 4. A high pressure turbine nozzle segment is designated in its entirety by the reference character 90. Although this embodiment is described with respect to a high pressure turbine nozzle segment 90, those skilled in the art will appreciate the present invention may be applied to other components of a gas turbine engine. For example, the present invention may be applied to the low pressure turbine of a gas turbine engine without departing from the scope of the present invention. Further, although this embodiment is described with respect to a segment, those skilled in the art will appreciate the present invention may be applied to unsegmented components extending completely around a centerline (not shown) of the gas turbine engine.

The nozzle segment 90 generally comprises a nozzle outer band segment 92, a plurality of nozzle vanes 94, an inner band segment 98, and a shroud segment 100 integrally formed with the outer band segment. The outer band segment 92 and shroud segment 100 extend circumferentially around the centerline of the engine and have a substantially continuous and uninterrupted inner surface 102 forming a portion of the outer flowpath boundary of the engine. As illustrated in FIG. 4 the nozzle segment 90 is mounted with conventional connectors to a shroud hanger 104 surrounding the shroud segment 100. Although other connectors 106 may be used without departing from the scope of the present invention, in one embodiment the connectors include conventional hook connectors. Conventional C-clips 108 are used to attach the aft connector 106 to the hanger 104.

As further illustrated in FIG. 4, the shroud hanger 104 cooperates with the shroud segment 100 to form an inner cooling air cavity 158. Furthermore, the shroud segment 100 is substantially free of openings extending through the shroud segment from its outer surface 160 to the inner surface 102.

The vanes 94 extend inward from the outer band 92. Each of these vanes 94 extends generally inward from an outer end 110 mounted on the outer band 92 to an inner end 112 opposite the outer end 110. Each vane 94 has an airfoil-shaped cross section for directing air flowing through the flowpath of the engine. The vanes 94 include interior passages 114, 116, 118. The passages 114, 116, 118 extend from inlets 120, 122, 124 to openings 126 in an exterior surface 128 of the vane 94 for conveying cooling air from the inlets to the openings 126. As will be appreciated by those skilled in the art, the forward and middle passages 114, 116, respectively, receive cooling air from an outer cavity 162, and the rearward passage 118 receives cooling air from the inner cavity 158 after that air impinges on the outer surface 160 of the shroud segment 100. Although the shroud segment 100 of the embodiment described above is positioned downstream from the nozzle vanes 94 when the component is mounted in the engine so it surrounds a row of blades (not shown) mounted downstream from the vanes, it is envisioned the integral shroud segment may be positioned upstream from the vanes so it surrounds a row of blades upstream from the vanes without departing from the scope of the present invention.

The inner band segment 98 extends circumferentially around the inner ends 112 of the vanes 94 and has an outer surface 130 forming a portion of an inner flowpath boundary of the engine. A flange 132 extends inward from the inner band segment 98 for connecting the nozzle segment 90 to a conventional nozzle support 134 with fasteners 136.

Although the gas turbine engine component of the present invention may be made in other ways without departing from the scope of the present invention, in one embodiment the outer band segment 92, vanes 94, inner band segment 98 and shroud segment 100 are cast as one piece. After casting, various portions of the component are machined to final component dimensions using conventional machining techniques.

The shroud segment 100 comprises a multiple impingement structure. The shroud segment 100 is formed by conventional means, for example casting. The shroud segment 100 incorporates rib 152 and baffle seats 154 and 156. A separately fabricated impingement baffle 140 having a first section 142, a second section 144, and a raised section 150 is received in the baffle seats and the rib 152. The impingement baffle 140 is brazed or welded in place. The baffle may be constructed as one piece as is illustrated in FIG. 4, or the first and second portions of the baffle 140 may be made separately and attached to the shroud segment 100. The baffle 140 could also be formed as an integral part of shroud 100. A plurality of first impingement cooling holes 146 are disposed in the first section 142 of the baffle 140. The first impingement cooling holes 146 have a diameter of approximately 0.51 mm (0.02 in.), an axial spacing of about 1.57 mm (0.062 in.), and a circumferential spacing of about 1.65 mm (0.065 in.). The first section 142 of the baffle 140 has an impingement distance of approximately 0.76 mm (0.03 in.). A plurality of second impingement cooling holes 148 are disposed in the second section 144 of the baffle 140. The second impingement cooling holes 148 have a diameter of approximately 0.56 mm (0.022 in.), an axial spacing of about 1.68 mm (0.066 in.), and a circumferential spacing of about 1.65 mm (0.065 in.). The second section 144 of the baffle 140 is has an impingement distance of approximately 0.84 mm (0.033 in.). An aft cavity 172 is generally bounded by the rib 152, the first section 142 of the baffle 140, the aft baffle seat 154, and an aft portion of the outer surface 160. A forward cavity 174 is generally bounded by the rib 152, a forward portion of the outer surface 160, the forward baffle seat 156, and the second section 142 of the baffle 140. The outer surface 160 of the shroud 100 has a surface that is selectively roughened through the incorporation of one or more pluralities of projecting members 170. Is this embodiment the projecting members 170 take the form of small truncated cones (illustrated in FIG. 3) which are incorporated into the casting of the shroud 100. The projecting members 170 have a base diameter db of about 0.51 mm (0.02 in.), a tip diameter dt of about 0.25 mm (0.01 in.), and a height h of about 0.38 mm (0.015 in.). The projecting members 170 are spaced approximately 1.27 mm (0.05 in.) apart. The projecting members 170 are disposed in the the forward cavity 174 and in the aft cavity 172. In the illustrated example, the projecting members 170 are arrayed over the entire outer surface 160 in each cavity.

As will be appreciated by those skilled in the art, the high pressure turbine nozzle segment 90 of the present invention has fewer leakage paths for cooling air than conventional nozzle assemblies. Rather than having a gap and potentially significant cooling air leakage between the outer band segment and the shroud segment, the nozzle segment 90 of the present invention has an integral outer band segment 92 and shroud segment 100. Further, rather than allowing all of the cooling air which impinges on the exterior surface of the shroud segment to leak directly into the flowpath, the nozzle segment 90 of the present invention directs much of the cooling air impinging on the outer surface 160 of the shroud segment 100 through cooling air passages 118 extending through the vanes 94 and out through film cooling openings 126 on the exterior surface 128 of the vanes. The air used to cool the shrouds 100 also cools the nozzle 94 and discharges through the openings 126 which are positioned upstream from the nozzle throat. Because the openings 126 are positioned upstream from the nozzle throat, the nozzle segment 90 of the present invention has better performance than conventional nozzle assemblies which discharge the cooling air downstream from the nozzle throat. Thus, as will be appreciated by those skilled in the art, the high pressure turbine nozzle segment 90 of the present invention requires less cooling air than a conventional nozzle assembly, allowing cooling air to be directed to other areas of the engine where needed and/or allowing overall engine efficiency to be increased.

Furthermore, the turbine nozzle segment 90 has improved consistency impingement cooling of the outer surface 160 in comparison to the prior art. Specifically, cooling air flow from inner air cavity 158 impingement cools the portion of the outer surface 160 that is in the aft cavity. The aft cavity 172 is substantially shorter than the entire shroud 100 in order to reduce the number of impingement cooling holes 146 and thus the cross-flow degradation. The aft cavity 172 contains a plurality of projecting members 170 in its forward end in order to increase the heat transfer coefficient and thus offset any reduction in cooling effectiveness in the partially spent cooling flow. Subsequently, the cooling air flows over rib 152 through a section of increasing area under the raised section 150 of the baffle 140, which tends to increase its static pressure, offsetting the loss in pressure from flow losses. Subsequently, the cooling air impinges through holes 148 into the forward cavity 174. The forward cavity 174 is substantially shorter than the entire shroud 100 in order to reduce the number of impingement cooling holes 148 and thus the cross-flow degradation. The forward cavity 174 also contains a plurality of projecting members 170 in its forward end in order to increase the heat transfer coefficient and thus offset any reduction in cooling effectiveness in the partially spent cooling flow. Finally, the spent cooling air from the forward cavity enters passage 118 through inlet 124, allowing further reuse of the cooling air. In this manner the present invention provides improved consistency of cooling within each stage of impingement cooling and from one stage to the next.

The foregoing has described a multiple impingement cooled structure is provided having two or more stages of impingement cooling wherein the stages are arranged so as to have substantially constant cooling effectiveness. While specific embodiments of the present invention have been described, it will be apparent to those skilled in the art that various modifications thereto can be made without departing from the spirit and scope of the invention as defined in the appended claims.

What is claimed is:

1. A multiple impingement cooled structure, comprising:

a base having an inner surface exposed to a hot gas flowpath and an outer surface exposed to a flow of cooling fluid;

a first baffle having a plurality of impingement cooling holes formed in a first section thereof, said cooling holes being in fluid communication with a source of cooling fluid for directing said cooling fluid against a first portion of said outer surface, said first section of said first baffle being spaced a first distance from said outer surface;

a cavity for receiving said cooling fluid after said cooling fluid has been directed against said first portion of said outer surface; and a second baffle having a plurality of impingement cooling holes in fluid communication with said cavity for directing said cooling fluid against a second portion of said outer surface, said second baffle being spaced a second distance from said outer surface, wherein said first distance and said second distance are substantially equal.

2. The multiple impingement cooled structure of claim 1 wherein said cavity comprises first, second, and third portions, wherein the area of said second portion adjacent said first portion is less than the area of said second portion adjacent said third portion.

3. The multiple impingement cooled structure of claim 2, wherein said first baffle further comprises second and third sections, and said second baffle has an upstream end and a downstream end with respect to said flow of cooling fluid, wherein said third section is disposed in spaced-apart relation to said second baffle at an angle such that the distance between said third section and said second baffle at said upstream end of said second baffle is less than the distance between said third section and said second baffle at said downstream end of said second baffle.

4. The multiple impingement cooled structure of claim 3 further comprising a plurality of projecting members extending from said outer surface, said plurality of projecting members being disposed in selected portions of said first portion of said outer surface and selected portions of said second portion of said outer surface.

5. A shroud for a gas turbine engine, comprising:

a shroud extending circumferentially around a centerline of said engine and having an inner surface, and an outer surface exposed to a flow of cooling fluid, said shroud comprising:

a first baffle having a plurality of impingement cooling holes formed in a first section thereof, said cooling holes being in fluid communication with a source of cooling fluid for directing said cooling fluid against a first portion of said outer surface, said first baffle being spaced a first distance from said outer surface;

a cavity for receiving said cooling fluid after said cooling fluid has been directed against said first portion of said outer surface; and a second baffle having a plurality of impingement cooling holes in fluid communication with said cavity for directing said cooling fluid against a second portion of said outer surface, said second baffle being spaced a second distance from said outer surface, wherein said first distance and said second distance are substantially equal.

6. The shroud of claim 5 wherein said cavity comprises first, second, and third portions, wherein the area of said second portion adjacent said first portion is less than the area of said second portion adjacent said third portion.

7. The shroud of claim 6 wherein said first baffle further comprises second and third sections, and said second baffle has an upstream end and a downstream end with respect to said flow of cooling fluid, wherein said third section is disposed in spaced-apart relation to said second baffle at an angle such that the distance between said third section and said second baffle at said upstream end of said second baffle is less than the distance between said third section and said second baffle at said downstream end of said second baffle.

8. The shroud of claim 7 further comprising a plurality of projecting members extending from said surface, said plurality of projecting members being disposed in selected portions of said first portion of said surface and selected portions of said second portion of said surface.

9. A gas turbine engine component comprising:

a nozzle outer band extending circumferentially around a centerline of the engine having an inner surface forming a portion of an outer flowpath boundary of the engine;

a plurality of nozzle vanes extending inward from the outer band, each of said vanes extending generally inward from an outer end mounted on the outer band to an inner end opposite said outer end;

an inner band extending circumferentially around the inner ends of said plurality of nozzle vanes having an outer surface forming a portion of an inner flowpath boundary of the engine; and a shroud integral with the outer band extending circumferentially around the centerline of the engine and having an inner surface forming a portion of the outer flowpath boundary of the engine adapted for surrounding a plurality of blades mounted in the engine for rotation about the centerline thereof, and an outer surface exposed to a flow of cooling fluid, said shroud comprising:

a first baffle having a plurality of impingement cooling holes formed in a first section thereof, said cooling holes being in fluid communication with a source of cooling fluid for directing said cooling fluid against a first portion of said outer surface, said first baffle being spaced a first distance from said outer surface;

a cavity for receiving said cooling fluid after said cooling fluid has been directed against said first portion of said outer surface; and a second baffle having a plurality of impingement cooling holes in fluid communication with said cavity for directing said cooling fluid against a second portion of said outer surface, said second baffle being spaced a second distance from said outer surface, wherein said first distance and said second distance are substantially equal.

10. The gas turbine engine component of claim 9 wherein said cavity comprises first, second, and third portions, wherein the area of said second portion adjacent said first portion is less than the area of said second portion adjacent said third portion.

11. The gas turbine engine component of claim 10 wherein said first baffle further comprises second and third sections, and said second baffle has an upstream end and a downstream end with respect to said flow of cooling fluid, wherein said third section is disposed in spaced-apart relation to said second baffle at an angle such that the distance between said third section and said second baffle at said upstream end of said second baffle is less than the distance between said third section and said second baffle at said downstream end of said second baffle.

12. The gas turbine engine component of claim 11 further comprising a plurality of projecting members extending from said surface, said plurality of projecting members being disposed in selected portions of said first portion of said surface and selected portions of said second portion of said surface.

* * * * *